US007134514B2

(12) United States Patent
Riel et al.

(10) Patent No.: US 7,134,514 B2
(45) **Date of Patent: *Nov. 14, 2006**

(54) DUAL WALL DRILL STRING ASSEMBLY

(75) Inventors: Bill Riel, Wooster, OH (US); Kris Church, Montgomery, TX (US)

(73) Assignees: American Augers, Inc., West Salem, OH (US); TorqueLock Corporation, Conroe, TX (US)

( * ) Notice: Subject to any disclaimer, the term of this patent is extended or adjusted under 35 U.S.C. 154(b) by 106 days.

This patent is subject to a terminal disclaimer.

(21) Appl. No.: 10/712,324

(22) Filed: Nov. 13, 2003

(65) Prior Publication Data

US 2005/0284664 A1 Dec. 29, 2005

(51) Int. Cl.
*E21B 21/12* (2006.01)

(52) U.S. Cl. ..... 175/320; 175/57

(58) Field of Classification Search ..... 175/320, 175/325.5, 325.6; 138/112; 285/123.3
See application file for complete search history.

(56) References Cited

U.S. PATENT DOCUMENTS

| | | | | | |
|---|---|---|---|---|---|
| 2,494,803 | A | * | 1/1950 | Frost et al. | 285/123.1 |
| 2,537,605 | A | | 1/1951 | Sewell | |
| 3,065,807 | A | * | 11/1962 | Wells | 175/321 |
| 3,265,091 | A | | 8/1966 | Jarnett | |
| 3,471,177 | A | * | 10/1969 | Garrett et al. | 285/123.3 |
| 3,638,970 | A | * | 2/1972 | Sandquist et al. | 285/24 |
| 3,786,878 | A | | 1/1974 | Chapman | |
| 3,830,319 | A | * | 8/1974 | van der Wijden | 175/215 |
| 4,067,596 | A | * | 1/1978 | Kellner et al. | 285/123.3 |
| 4,149,739 | A | * | 4/1979 | Morris | 285/123.15 |
| 4,280,535 | A | * | 7/1981 | Willis | 138/112 |
| 4,484,641 | A | | 11/1984 | Dismukes | |
| RE32,267 | E | | 10/1986 | Cherrington | |
| 4,732,223 | A | | 3/1988 | Schoeffler et al. | |
| 4,940,098 | A | | 7/1990 | Moss | |
| 4,997,048 | A | | 3/1991 | Isom | |
| 5,269,384 | A | | 12/1993 | Cherrington | |
| 5,467,832 | A | | 11/1995 | Orban et al. | |
| 5,713,423 | A | | 2/1998 | Martin et al. | |
| 6,296,066 | B1 | | 10/2001 | Terry et al. | |
| 6,364,038 | B1 | | 4/2002 | Driver | |
| 6,367,564 | B1 | | 4/2002 | Mills et al. | |
| 6,388,577 | B1 | | 5/2002 | Carstensen | |
| 6,443,244 | B1 | | 9/2002 | Collins | |
| 2002/0084109 | A1 | | 7/2002 | Runquist et al. | |

* cited by examiner

*Primary Examiner*—David Bagnell
*Assistant Examiner*—Daniel P Stephenson
(74) *Attorney, Agent, or Firm*—Charles D. Gunter, Jr.

(57) ABSTRACT

A dual wall drill string assembly for subsurface drilling. The drill string assembly includes a metallic outer tube having an outer tube first end and an outer tube second end opposite the outer tube first end. The assembly also includes a flexible, substantially non-metallic inner tube that is substantially enclosed within and generally coaxially aligned with the outer tube. The flexible, substantially non-metallic inner tube has an inner tube first end, an inner tube second end opposite the inner tube first end, and an inner tube inner diameter. The inner tube and the outer tube define an annular channel therebetween. The drill string assembly also includes a means for conveying fluid through the annular channel toward the inner tube first end. The annular channel is adapted to convey drilling fluid under pressure toward the inner tube first end, and the inner tube is adapted to convey cuttings toward the inner tube second end.

19 Claims, 6 Drawing Sheets

DUAL WALL DRILL STRING ASSEMBLY

FIELD OF THE INVENTION

The present invention relates generally to drill string assemblies. More particularly, the invention relates to a dual wall drill string assembly for use in subsurface drilling applications.

BACKGROUND AND DESCRIPTION OF THE PRIOR ART

Drill pipe is used in various ways and for different applications such as mining for diamonds, installing public and private utilities, drilling for oil and gas, creating an avenue to link the surface to one or more reservoirs, and linking a location on the surface or the subsurface with another surface or subsurface location. Accordingly, drill pipe comes in specialized configurations particularly adapted for use in one or more different applications. For example, drill pipe may comprise a single wall construction made from exotic steels to withstand hostile fluid and gases. Alternatively, drill pipe may comprise a dual wall construction adapted for use in reverse circulation drilling applications. Depending upon the application and environmental issues, a particular type of drill pipe may be preferable to another based upon cost, proven scientific principles, physical limitations and the like.

Regardless of the application, conventional single-walled drill pipe utilizes the same basic technique: fluids such as drilling muds are pumped down the inside of the pipe and cuttings produced by the drilling process are carried with the drilling mud to the earth's surface along the outside of the drill pipe. More particularly, the cuttings are carried out of the hole either between the borehole and the drill pipe or between a cased hole and the drill pipe. Some exotic types of drilling such as underbalanced drilling deal with the pressure differential between the bottom hole pressures and the surface pressures. This method of drilling is controllable, but it is dangerous.

In addition, single-walled drill pipe exposes the borehole to the drilling mud or fluids until the borehole is cased or cemented. Further, when the returned drilling mud or fluids and cuttings pass through the drilled hole, the hole can become plugged, thereby limiting the movement of the drill pipe. One technique employed to overcome the problem of plugging is to increase the mud flow volume and to circulate the borehole before further drilling is performed. This technique, however, impacts the earth's formation by forming cracks in the borehole, for example. Typically, much, if not all of the additional mud flows into the cracks and/or produces additional cracks. In addition, when the hole is close to the surface, the additional mud can seep or flow to the surface in a process known as "fracing out," which raises environmental concerns.

Reverse circulation drilling is a distinct drilling technique in which fluids are pumped to the drill bit and cuttings are transferred back to the earth's surface within the drill pipe assembly. This technique can be very advantageous because the drilling mud or fluid has limited exposure to the borehole and creates negligible damming effect. Also, it is environmentally-friendly in drilling applications that involve sensitive aquifers for drinking water and the like. The drill pipe typically used in reverse circulation drilling, however, is very stiff and difficult to steer and bend in a borehole. Thus, its use is limited to relatively straight hole applications, and it is not typically used in deviated hole drilling applications, which are commonly used in the construction, oil and gas, and mining industries.

In conventional drill pipes, wires are typically inserted and spliced inside each drill pipe to communicate with a gyroscope or compass transmitter in order to identify the location of the drill bit below the earth's surface. However, these wires are typically exposed and, therefore, are vulnerable to damage from short circuiting and breakage during the drilling operation.

It would be desirable, therefore, if an apparatus could be provided that would permit double-walled drill string pipe sections to be used for reverse-circulation, horizontal directional and deviated vertical drilling. It would also be desirable if such an apparatus could be provided that would permit the double-walled drill string pipe sections to bend along the arcuate path of a subsurface borehole as freely as a single-walled drill pipe. It would be further desirable if such an apparatus could be provided that would convey larger-sized cuttings and increased volumes of cuttings from the drilling mechanism to the surface of the ground. It would be further desirable if such an apparatus could be provided that would permit drilling in soft, medium or hard rock formations as well as corrosive formations with reduced negative environmental impact and reduced borehole wall damage. It would be further desirable if such an apparatus could be provided that would reduce or eliminate the risk of short circuiting the conductive wires on the drill string pipe sections. It would also be desirable if such an apparatus could be provided that would permit an operator at the ground surface to know immediately what rock or soil formation the drill is cutting as well as the condition of the drill bit. It would be still further desirable if such an apparatus could be provided that would produce a more efficient drilling mechanism by decreasing discharge back-pressure experienced during drilling operations utilizing conventional drill pipe. It would be further desirable if such an apparatus could be provided that would achieve longer pilot borehole distances and have a longer lifespan in the borehole. It would be still further desirable if such an apparatus could be provided that would permit the apparatus to be more easily assembled and perform drilling more efficiently, more quickly, and less costly.

ADVANTAGES OF THE INVENTION

Accordingly, it is an advantage of the invention claimed herein to provide an apparatus that includes double-walled drill string pipe sections adapted for use in all subsurface drilling applications. It is another advantage of the invention to provide an apparatus having an inner tube adapted to bend to the arcuate path of a borehole with little or no resistance. It is also an advantage of the invention to provide an apparatus capable of conveying larger-sized cuttings and increased volumes of cuttings from the drilling mechanism to the surface of the ground. It is also an advantage of the invention to provide an apparatus that is capable of drilling in soft, medium or hard formations as well as corrosive formations with reduced negative environmental impact and reduced borehole wall damage. It is a further advantage of the invention to provide an apparatus that reduces or eliminates the risk of short circuiting the conductive wires on the drill string pipe sections. It is a still further advantage of the invention to provide an apparatus that permits an operator at the ground surface to know what rock or soil formation the drill is cutting and the location of the drill bit. It is another advantage of the invention to provide an apparatus that produces a more efficient drilling mechanism by decreasing the incidence of "fracing out" of the subsurface formation. It is yet another advantage of the invention to provide an apparatus that achieves longer pilot borehole distances and has a longer lifespan in the borehole. It is a further advantage of the invention to provide an apparatus that is more easily assembled and performs all subsurface drilling more efficiently, more quickly, and less costly.

Additional advantages of the invention will become apparent from an examination of the drawings and the ensuing description.

EXPLANATION OF TECHNICAL TERMS

As used herein, the term "arcuate" refers to a curving, bending, turning, arching or other non-straight line, path or direction.

As used herein, the term "arcuate path that is generally horizontal" refers to a borehole having an entry hole and a separate exit hole that are connected by a curved path. It is contemplated within the scope of the term "arcuate path that is generally horizontal" that the borehole may have a longer vertical component than its horizontal component.

As used herein, the term "conductive" means able to convey, transmit or otherwise communicate a signal and/or provide electrical current.

As used herein, the term "fluid" relates to a liquid, a gas, or a combination of liquid and gas. The term "fluid" includes, without limitation, mixtures of solids and water, oils, other chemicals and the like.

As used herein, the term "signal" refers to a means for communication between a transmitter and a receiver. The term "signal" includes, without limitation, analog signals, digital signals, multiplexing signals, light signals and the like.

As used herein, the term "steerable" means the ability to follow the deviated path of a planned drilled hole.

As used herein, the term "substantially vertical borehole" refers to a borehole that is drilled substantially perpendicular to the earth's surface. The term "substantially vertical borehole" includes, without limitation, boreholes that are arcuate, curved and the like. It is also contemplated that the term "substantially vertical borehole" refers to a borehole that is a combination of vertical and horizontal drilling in relation to the earth's surface.

As used herein, the term "subsurface drilling" refers to any type of drilling employed by any industry that uses drill pipe to drill holes into the earth's formation, including, without limitation, soil, rock, ice, permafrost, wetlands, sand and the like.

SUMMARY OF THE INVENTION

The invention claimed herein comprises a dual wall drill string assembly for subsurface drilling. The drill string assembly includes a metallic outer tube having an outer tube first end and an outer tube second end opposite the outer tube first end. The assembly also includes a flexible, substantially non-metallic inner tube that is substantially enclosed within and generally coaxially aligned with the outer tube. The flexible, substantially non-metallic inner tube has an inner tube first end, an inner tube second end opposite the inner tube first end, and an inner tube inner diameter. The inner tube and the outer tube define an annular channel therebetween. The drill string assembly also includes a means for conveying fluid through the annular channel toward the inner tube first end. The annular channel is adapted to convey drilling fluid under pressure toward the inner tube first end, and the inner tube is adapted to convey cuttings toward the inner tube second end.

In a preferred embodiment of the drill string assembly of the invention claimed herein, a conductive element is substantially enclosed within the flexible, substantially non-metallic inner tube and adapted to convey a signal to allow the operator to control the direction of the drilling mechanism. In another preferred embodiment, flexible sleeves with openings are provided in the annular channel in order to maintain the outer tube and the inner tube in substantially concentric relationship to each other and permit fluid under pressure to be conveyed through the annular channel.

According to the method of the invention claimed herein, the dual wall drill string assembly is adapted to produce a subsurface borehole. In a preferred embodiment, the assembly is adapted to produce a substantially vertical subsurface borehole or a substantially horizontal subsurface borehole having an arcuate path. In another preferred embodiment, the assembly is adapted to pull a product into the arcuate path of a subsurface borehole.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
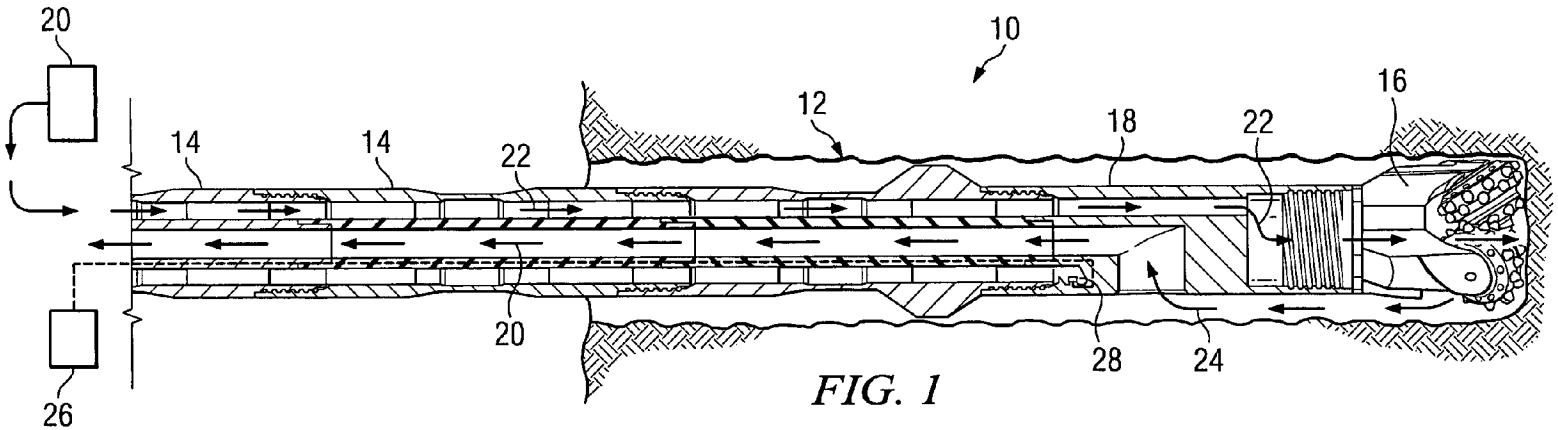
FIG. 1 is a sectional side view of a preferred embodiment of the dual wall drill string assembly partially in a subsurface borehole in accordance with the present invention.

Referring now to the drawings, the apparatus of the invention claimed herein is illustrated by FIGS. 1 through 8. FIG. 1 illustrates a preferred embodiment of the dual wall drill string assembly partially in a subsurface borehole. The preferred dual wall drill string assembly is designated generally by reference numeral 10 and the subsurface borehole is designated by reference numeral 12. As shown in FIG. 1, the preferred drill string assembly may comprise a plurality of dual wall pipe sections 14. It is contemplated, however, that the drill string assembly of the invention claimed herein may comprise a single dual wall pipe. The preferred drill string assembly may further comprise a drilling mechanism, an interchange sub, a means for conveying fluid under pressure, a signal source such as a transmitter or a source of electricity, a receiver, and a navigation transmitter as described in more detail below. It is further contemplated that the assembly may be used in connection with any suitable steering mechanism such as a bent sub or a deflectable drill bit as will be appreciated by one having ordinary skill in the art. The dual wall drill string assembly of the present invention is adapted for use in all subsurface drilling applications.

Referring still to FIG. 1, in the preferred drill string assembly, a plurality of dual wall pipe sections 14 are connected together to produce a dual wall drill string. As shown in FIG. 1, the preferred dual wall drill string comprising dual wall pipe sections 14 is connected to drilling mechanism 16 by interchange sub 18. Drilling mechanism 16 is adapted to produce cuttings as it drills subsurface borehole 12. Drilling mechanism 16 may be any suitable drilling mechanism adapted to drill a subsurface borehole such as a rotary cutter or a down-the-hole hammer. Interchange sub 18 is adapted to direct cuttings from the drilling mechanism to the dual wall drill string assembly. More particularly, as discussed below, interchange sub 18 directs cuttings and fluid under pressure from the subsurface borehole into the inner tube of the dual wall drill string. Interchange sub 18 may be any suitable device adapted to direct cuttings from the drilling mechanism to the dual wall drill string. Also, the interchange sub drilling mechanism or use of a separate interchange sub may have communication capabilities such as a location transmitter. It is also contemplated that the drill string assembly of the invention may not require an interchange sub because a channel through which cuttings may be transferred from the drilling mechanism to the drill string may be incorporated into the drilling mechanism.

Still referring to FIG. 1, the preferred drill string assembly also includes a means for conveying fluid through the dual wall drill string towards the drilling mechanism such as pump 20. More particularly, as discussed below, pump 20 is adapted to convey fluid under pressure through an annular channel defined by the outer tube and the inner tube of the dual wall drill string towards drilling mechanism 16. The flow of fluid from pump 20 through the annular channel of the dual wall drill string and, thereafter, through interchange sub 18 towards drilling mechanism 16 is designated by arrowed line 22. The flow of cuttings and fluid from drilling mechanism 16 into interchange sub 18 and, thereafter, into the inner tube of the dual wall drill string is designated by arrowed lines 24. It is contemplated within the scope of the invention that the means for conveying fluid through the annular channel of the dual wall drill string toward the drilling mechanism may be any suitable means for conveying fluid under pressure.

As also shown in FIG. 1, the preferred embodiment of the dual wall drill string assembly includes signal source of electricity 26 adapted to provide an electrical current to navigation transmitter 28, which is adapted to indicate the direction of drilling mechanism 16. Source of electricity 26 may be any suitable source for providing an electrical current. Navigation transmitter 28 may be any suitable device adapted to monitor the direction of the drilling mechanism.

Figure 2:
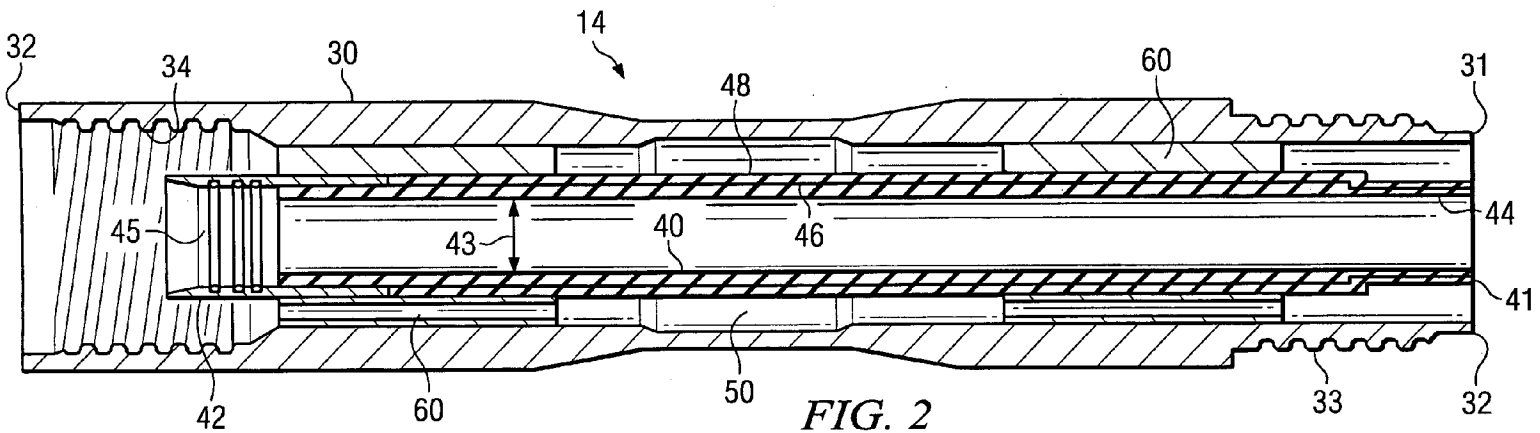
FIG. 2 is an enlarged sectional side view of the preferred dual wall drill string pipe section shown in FIG. 1.

Referring now to FIG. 2, an enlarged sectional side view of the preferred dual wall pipe section 14 shown in FIG. 1 is illustrated. Pipe section 14 includes metallic outer tube 30 having outer tube first end 31 and outer tube second end 32 opposite the outer tube first end. In a preferred embodiment, drilling mechanism 16 (See FIG. 1) is located adjacent to outer tube first end 31 of a dual wall pipe section such as pipe section 14. Outer tube first end 31 is adapted to be connected to the outer tube second end of another pipe section such that fluid may be conveyed under pressure in the outer tubes of the pipe sections. Outer tube second end 32 is adapted to be connected to the outer tube first end of another pipe section such that fluid may be conveyed under pressure in the outer tubes of the pipe sections. In a preferred embodiment, outer tube 30 of each dual wall pipe section 14 is rigid and includes a pair of threaded ends 33 and 34 adapted to be removably connected to a threaded end on another rigid outer tube section.

As shown in FIG. 2, the preferred dual wall pipe section 14 also includes flexible, substantially non-metallic inner tube 40 that is substantially enclosed within and generally coaxially aligned with outer tube 30. Inner tube 40 includes inner tube first end 41, inner tube second end 42 opposite the inner tube first end, and an inner tube inner diameter designated by line 43. Inner tube first end 41 is adapted to be connected to the inner tube second end of another pipe section such that cuttings and fluid under pressure may be conveyed in the inner tubes of the pipe sections. Inner tube second end 42 is adapted to be connected to the inner tube first end of another pipe section such that cuttings and fluid under pressure may be conveyed in the inner tubes of the pipe sections. More particularly, an inner tube such as inner tube 40 is adapted to convey cuttings from drilling mechanism 16 toward inner tube second end 42. In a preferred embodiment, the drill string assembly is comprised of a plurality of pipe sections 14, each of which includes a flexible inner tube section 40, wherein each of the flexible inner tube sections has male connection end 44 and female connection end 45. Each male connection end 44 is adapted to be connected to a female connection end on another flexible inner tube section and each female connection end 45 is adapted to be connected to a male connection end on another flexible inner tube section. It is also preferred that each flexible inner tube section is in communication (as hereinafter described) with each adjacent flexible inner tube section.

Still referring to FIG. 2, the preferred inner tube 40 also includes conductive element 46 for conveying a signal such as an electrical signal from source of electricity 26 (See FIG. 1) to drilling mechanism 16 (See FIG. 1). The signal may be used to indicate the direction of the drilling mechanism. In a preferred embodiment, conductive element 46 is continuous from inner tube first end 41 to inner tube second end 42 so that a continuous conductive path is provided from one end of the drill string to the other and provides an electrical current from the source of electricity to a navigation device. It is also preferred that conductive element 46 is substantially enclosed within inner tube 40. Furthermore, conductive element 46 preferably comprises at least one metallic or fiber optic material. It is also preferred that conductive element 46 includes metallic wire, metallic mesh or thin wall pipe. It is contemplated within the scope of the invention, however, that conductive element 46 may be any suitable material for conveying a signal such as an electrical current.

The preferred inner tube also includes a means for reinforcing the inner tube such as mesh 48. Mesh 48 is adapted to provide structural support to the flexible, substantially non-metallic inner tube. More particularly, mesh 48 is adapted to enable inner tube 40 to withstand greater pressure differentials between the pressure in annular channel 50 and the pressure in the inner tube. In other words, mesh 48 provides the inner tube with resistance against collapsing when the pressure in the annular channel becomes significantly greater than the pressure in the inner tube, and resistance against bursting when the pressure in the inner tube becomes significantly greater than the pressure in the annular channel. In addition, mesh 48 is adapted to minimize the bending resistance of the inner tube. As a result, mesh 48 does not significantly impair the steerability of the drill string assembly. Mesh 48 may be made from wire mesh, fabric mesh, thin wall metallic tube or any other suitable material adapted to provide resistance against pressure differentials between the annular channel and the inner tube and minimize resistance against bending or steering the inner tube. It is contemplated that mesh 48 may be located throughout the inner tube or in designated areas. It is further contemplated that mesh 48 may be substantially enclosed within the inner tube, applied to the exterior or interior surfaces of the inner tube, or a combination thereof.

Referring still to FIG. 2, outer tube 30 and inner tube 40 define annular channel 50 therebetween. The annular channel is adapted to convey fluid under pressure from the means for conveying fluid such as pump 20 (See FIG. 1) toward the inner tube first end. More particularly, annular channel 50 is adapted to convey drilling fluid under pressure from inner tube second end 42 toward inner tube first end 41.

As shown in FIG. 2, the preferred dual wall pipe section 14 also includes at least one centering member such as flexible sleeve 60 that is located in annular channel 50. In a preferred embodiment, at least one flexible sleeve 60 is adapted to maintain outer tube 30 and inner tube 40 in a substantially concentric relationship to each other. Also in a preferred embodiment, flexible sleeve 60 has at least one opening therein such as holes 262 (See FIG. 5A). In an alternative embodiment, flexible sleeve 360 includes apertures 362 (See FIG. 5B). It is also preferred that the cumulative area of the openings in the flexible sleeves is greater than the cross-sectional area defined by inner tube inner diameter 43.

Figure 3:
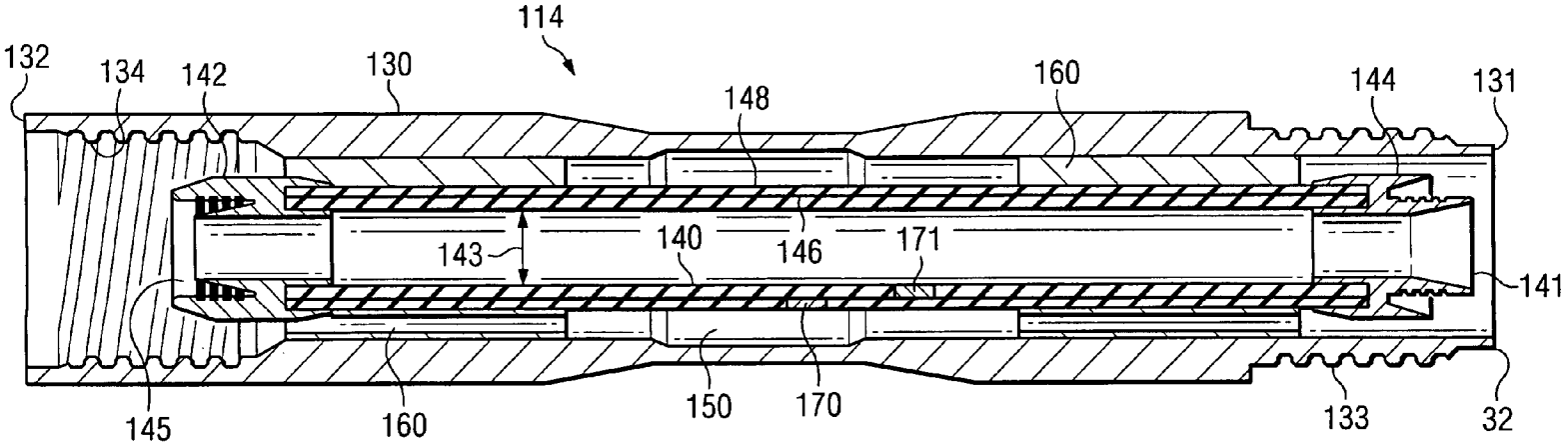
FIG. 3 is a sectional side view of an alternative embodiment of the dual wall drill string pipe section in accordance with the present invention.

Referring now to FIG. 3, an alternative embodiment of a dual wall pipe section is illustrated. More particularly, FIG. 3 illustrates an alternative embodiment of the male connection end and the female connection end of the flexible, substantially non-metallic inner tube of a dual wall pipe section. As shown in FIG. 3, dual wall pipe section 114 includes metallic outer tube 130 having outer tube first end 131 and outer tube second end 132 opposite the outer tube first end.

The outer tube also includes a pair of threaded connections 133 and 134 adapted to be connected to the threaded connections of another pipe section 114. Pipe section 114 also includes flexible, substantially non-metallic inner tube 140. Inner tube 140 includes inner tube first end 141, inner tube second end 142 opposite the inner tube first end, and inner tube inner diameter designated by line 143. Inner tube 140 also includes male connection end 144 and female connection end 145 which are adapted to be connected to the female connection end and the male connection end, respectively, of an inner tube of another pipe section such that adjacent pipe sections are in communication with each other, fluid can be conveyed under pressure through annular channel 150, and cuttings and fluid under pressure can be conveyed in the inner tubes of the pipe sections. Inner tube 140 also includes conductive element 146, stiffener 148 and flexible sleeves 160. While stiffener 148 is shown on the outside surface of preferred inner tube 140, it is contemplated within the scope of the invention that one or more stiffeners may be located on the inside surface of the inner tube or substantially or entirely enclosed within the inner tube.

Figure 4A:
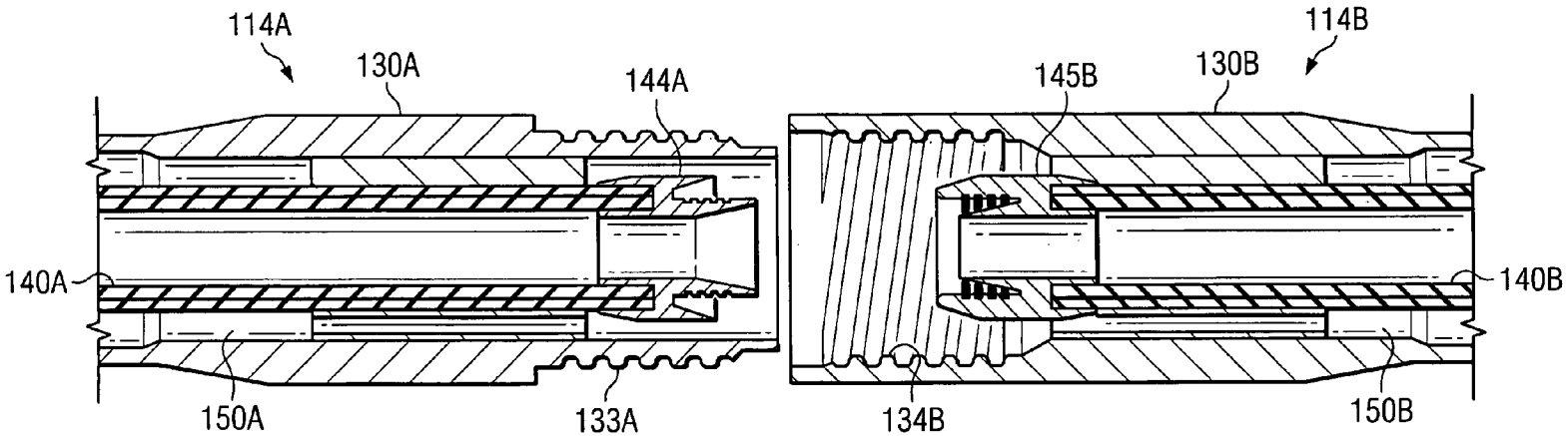
FIG. 4A is a sectional side view of a pair of the dual wall drill string pipe sections shown in FIG. 3.
Figure 4B:
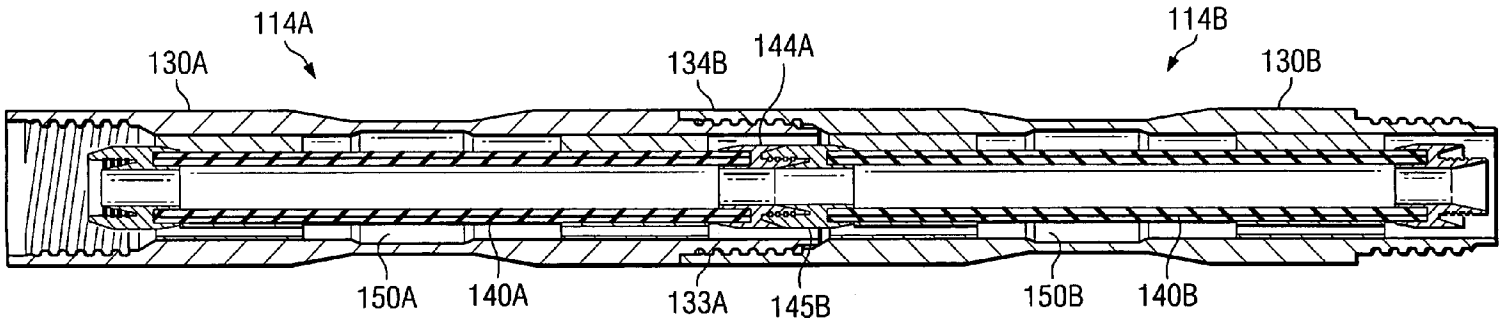
FIG. 4B is a sectional side view of the pair of dual wall drill string pipe sections shown in FIG. 3 connected to each other.

Referring now to FIGS. 4A and 4B, a pair of dual wall pipe sections are illustrated in nearly-connected and connected disposition, respectively. More particularly, FIG. 4A shows a pair of pipe sections 114A and 114B in a nearly-connected relationship to each other. As shown in FIG. 4A, pipe section 114A includes metallic outer tube 130A having threaded end 133A adapted to be connected to threaded end 134B of outer tube 130B of pipe section 114B. Pipe section 114A also includes flexible, substantially non-metallic inner tube 140A. Inner tube 140A includes male connection end 144A which is adapted to be connected to female connection end 145B of inner tube 140B of pipe section 114B. Male connection end 144A and female connection end 145B are adapted to be connected to each other such that inner tubes 140A and 140B are in communication with each other and cuttings and fluid under pressure can be conveyed through annular channels 150A and 150B of pipe sections 114A and 114B, respectively.

Referring now to FIG. 4B, the preferred pipe sections shown in FIG. 4A are illustrated in connected relationship to each other. More particularly, threaded ends 133A and 134B of outer tubes 130A and 130B, respectively, are shown in full threaded engagement with each other. In addition, male connection end 144A and female connection end 145B of inner tubes 140A and 140B, respectively, are shown connected to each other such that inner tubes 140A and 140B are in communication with each other, fluid under pressure may be conveyed through annular channels 150A and 150B, and cuttings and fluid under pressure may be conveyed through the inner tubes 140A and 140B.

Figure 5B:
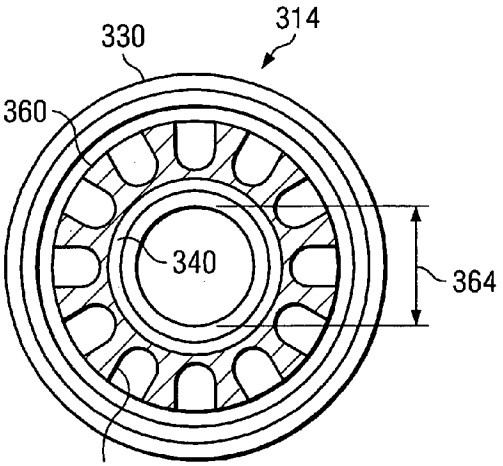
FIG. 5B is a cross-sectional view of an alternative embodiment of the flexible sleeve in accordance with the present invention.
Figure 5A:
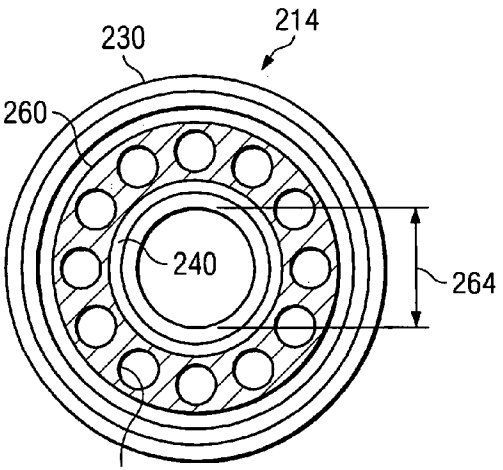
FIG. 5A is a cross-sectional view of a preferred embodiment of the flexible sleeve in accordance with the present invention.

Referring now to FIGS. 5A and 5B, two cross-sectional views of preferred embodiments of dual wall pipe sections 214 and 314, respectively, are illustrated. As shown in FIG. 5A, preferred pipe section 214 includes outer tube 230, inner tube 240 and flexible sleeve 260. Flexible sleeve 260 includes a plurality of holes 262. Holes 262 are adapted to permit fluid under pressure to be conveyed therethrough. It is contemplated that the cumulative area of holes 262 in flexible sleeve 260 may be greater than the cross-sectional area defined by inner tube inner diameter 264. It is also contemplated that the cumulative area of holes 262 in flexible sleeve 260 may be less than or equal to the cross-sectional area defined by inner tube inner diameter 264.

Referring now to FIG. 5B, preferred dual wall pipe section 314 includes outer tube 330, inner tube 340 and flexible sleeve 360. Flexible sleeve 360 includes a plurality of apertures 362. Apertures 362 are adapted to permit fluid under pressure to be conveyed therethrough. It is contemplated that the cumulative area of apertures 362 in flexible sleeve 360 may be greater than the cross-sectional area defined by inner tube inner diameter 364. It is also contemplated that the cumulative area of apertures 362 in flexible sleeve 360 may be less than or equal to the cross-sectional area defined by inner tube inner diameter 364. While FIGS. 5A and 5B illustrate flexible sleeve 260 having a plurality of round holes 262 and flexible sleeve 360 having a plurality of arched apertures 362, respectively, it is contemplated within the scope of the invention that one or more openings of any suitable configuration and location may be provided in the flexible sleeves of the present invention.

Figure 6:
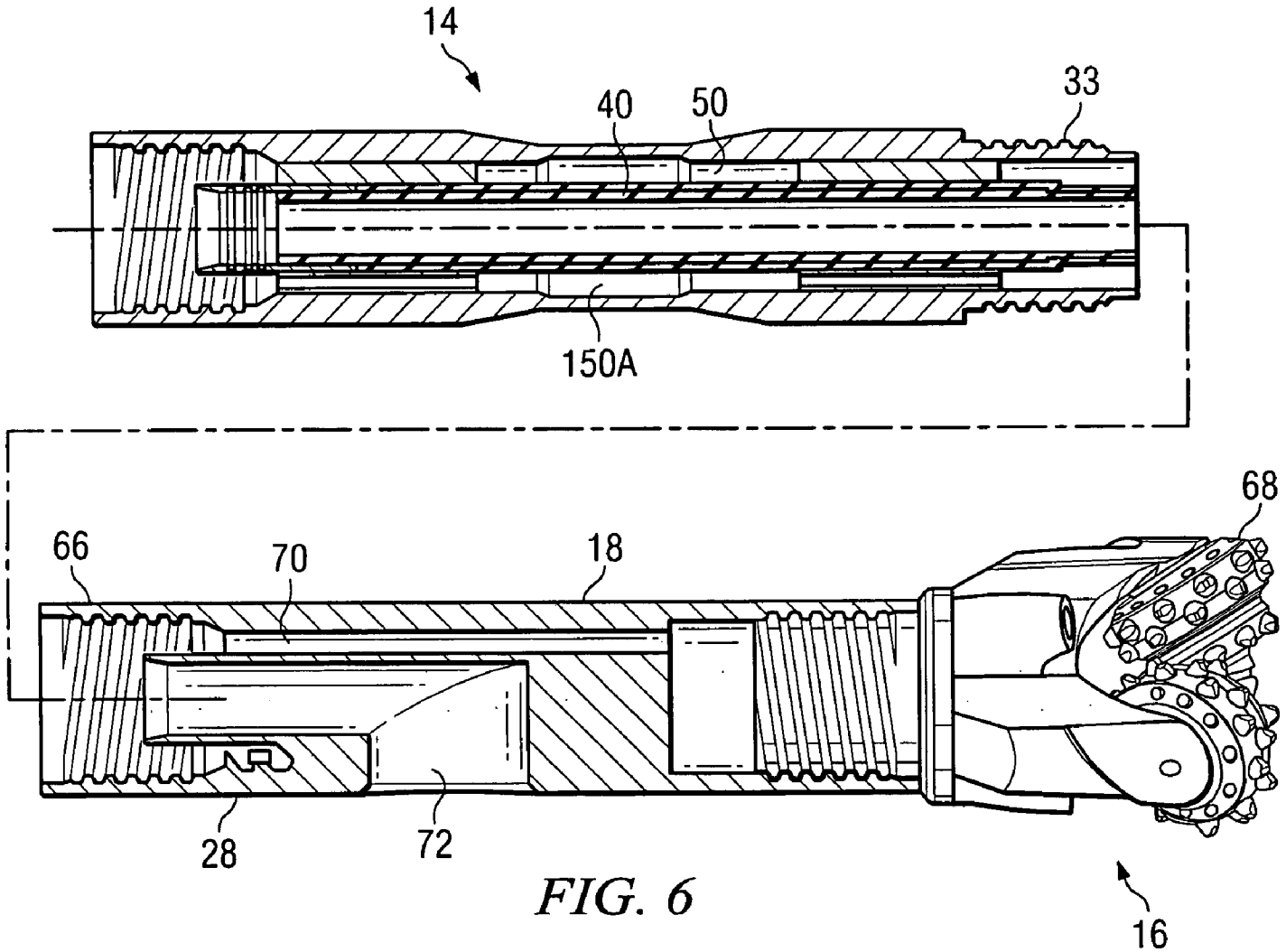
FIG. 6 is a sectional side view of a preferred dual wall drill string pipe section and a drilling mechanism.

Referring now to FIG. 6, preferred dual wall pipe section 14 is illustrated in a nearly-connected relationship to interchange sub 18. Preferred pipe section 14 is illustrated in FIGS. 1 and 2 and described in detail above. As shown in FIG. 6, threaded end 33 is adapted to be connected to threaded end 66 of interchange sub 18. Drilling mechanism 16 includes navigation transmitter 28, cutting head 68, fluid channel 70, and cuttings channel 72. Drilling head 68 is adapted to drill a subsurface borehole as illustrated in FIG. 1. Drilling head 68 may be any suitable mechanism for drilling a subsurface borehole. Fluid channel 70 is adapted to convey fluid under pressure from annular channel 50 of pipe section 14 to drilling head 68 of drilling mechanism 16. Fluid channel 70 may be of any suitable conventional configuration adapted to convey fluid under pressure toward the drilling head of the drilling mechanism. Cuttings channel 72 is adapted to convey cuttings produced by the drilling head of the drilling mechanism from the subsurface borehole to inner tube 40 of pipe section 14. Cuttings channel 72 on interchange sub 18 may be of any suitable configuration for conveying cuttings from the drilling mechanism to the inner tube of one or more dual wall pipe sections.

Figure 7:
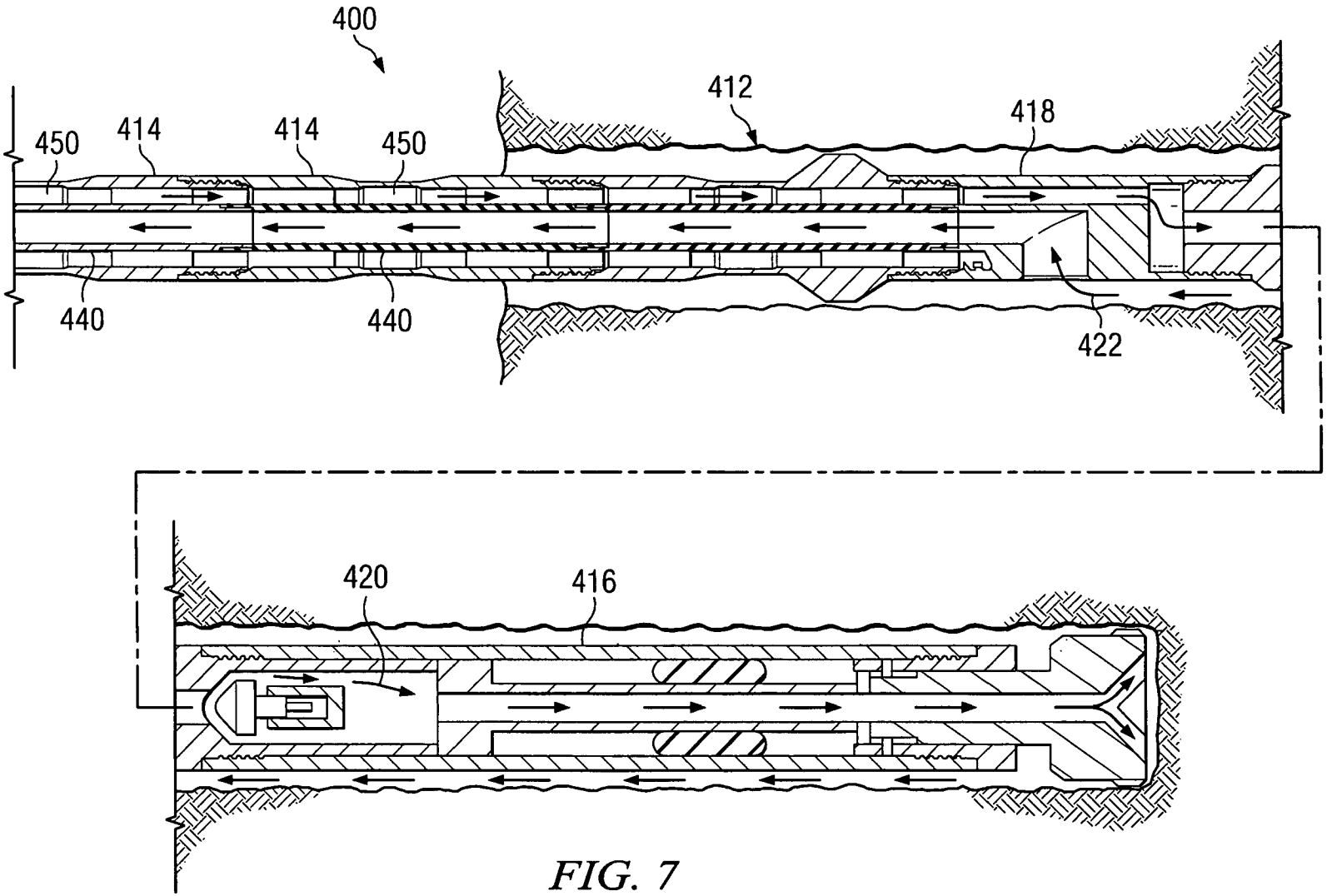
FIG. 7 is a sectional side view of an alternative embodiment of the dual wall drill string assembly partially in a subsurface borehole in accordance with the present invention.

Referring now to FIG. 7, an alternative embodiment of the dual wall drill string assembly is illustrated. More particularly, FIG. 7 illustrates a preferred dual wall drill string assembly utilizing a drilling mechanism commonly known as a down-the-hole percussion hammer. As shown in FIG. 7, preferred assembly 400 includes a plurality of dual wall pipe sections 414 connected to each other. The drill string of dual wall pipe sections 414 is connected to drilling mechanism 416 by interchange sub 418. Drilling mechanism 416 is adapted to drill subsurface borehole 412. Interchange sub 418 is adapted to convey cuttings from drilling mechanism 416 to inner tubes 440 of pipe sections 414. The flow of fluid conveyed under pressure from annular channels 450 of pipe sections 414 through interchange sub 418 and, thereafter, towards drilling mechanism 416 is designated by arrowed line 420. The flow of cuttings and fluid under pressure from drilling mechanism 416 to interchange sub 418 and, thereafter, to the inner tubes of pipe sections 414 is designated by arrowed lines 422.

Figure 8:
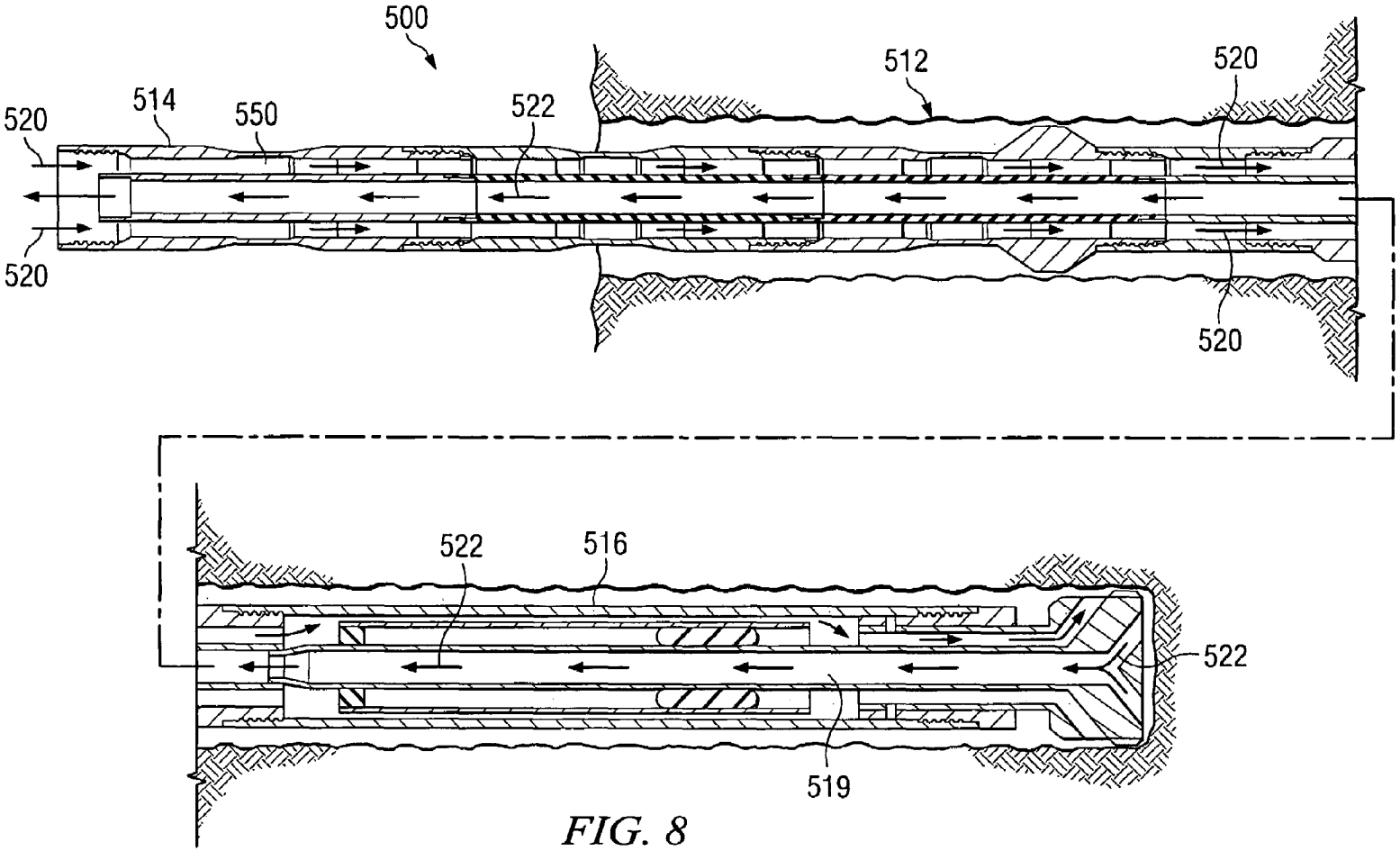
FIG. 8 is a sectional side view of an alternative embodiment of the dual wall drill string assembly partially in a subsurface borehole in accordance with the present invention.

Referring now to FIG. 8, an alternative embodiment of the dual wall string assembly is illustrated. More particularly, FIG. 8 illustrates a preferred dual wall string assembly without an interchange sub. As shown in FIG. 8, preferred assembly 500 includes dual wall pipe section 514 which is connected directly to drilling mechanism 516. Drilling mechanism 516 is adapted to drill subsurface borehole 512. Drilling mechanism 516 includes cuttings channel 519 which is adapted to convey cuttings from the drilling mechanism to the dual wall pipe section.

The flow of fluid conveyed under pressure through annular channel 550 of pipe section 514 towards drilling mechanism 516 is designated by arrowed lines 520. The flow of cuttings and fluid under pressure from drilling mechanism 516 to the inner tube of pipe section 514 is designated by arrowed line 522. The foregoing describes the operation of a reverse circulation down-the-hole hammer.

In operation, several advantages of the dual wall drill string assembly of the present invention are achieved. First, a borehole is drilled by the drilling mechanism. The cuttings produced by the drilling mechanism are conveyed to the inside of the flexible, substantially non-metallic inner tube of the dual wall drill string as fluid under pressure is conveyed through the annular channel of the dual wall drill string toward the drilling mechanism. Moreover, the dual wall drill string assembly of the invention claimed herein is adapted for use in all subsurface drilling applications. The flexible, substantially non-metallic inner tube of the dual wall drill string assembly of the present invention permits the assembly to be used in all subsurface drilling applications because the inner tube is flexible and transmits considerably less bending resistance to the outer tube. In addition, the flexible, substantially non-metallic inner tube is adapted to substantially enclose a conductive element for conveying a signal to the navigation transmitter. Consequently, the direction of the drilling mechanism can be monitored, and short circuiting of the conductive element on the metallic outer tube is avoided. Flexible sleeves also contribute to the ability of the preferred embodiment of the dual wall drill assembly of the present invention to function in any subsurface drilling application(s). Further, according to the method of the invention claimed herein, the dual wall drill string assembly is capable of reaming the arcuate path of a borehole in any subsurface drilling application(s). Still further, the assembly is capable of pulling or pushing a product such as pipeline, ducts and the like into the arcuate path of a subsurface borehole.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents of the appended claims.

What is claimed is:

1. A dual wall drill string assembly which allows dual circulation for directional drilling, said assembly comprising:

(A) a metallic outer tube having:
  (1) an outer tube first end;
  (2) an outer tube second end opposite the outer tube first end;

(B) a flexible, substantially non-metallic inner tube that is substantially enclosed within and generally coaxially aligned with the outer tube, said inner tube having:
  (1) an inner tube first end;
  (2) an inner tube second end opposite the inner tube first end which defines a tube length therebetween;
  (3) an inner tube diameter which is generally constant along the tube length from the inner tube first end to the inner tube second end;
  (4) wherein the flexible inner tube comprises a plurality of flexible inner tube sections, each of said flexible inner tube sections having a male connection end and a female connection end, each male section end being adapted to be connected to a female connection end on another flexible inner tube section and each female connect and being adapted to be connected to a male connection end on another flexible inner tube section;

wherein the inner tube and the outer tube define an annular channel there between, wherein the non-metallic inner tube is formed of a material which allows it to bend to an arcuate path of a borehole for drilling a deviated wellbore without limiting bending of the metallic outer tube;

(C) a means for conveying fluid through the annular channel toward the inner tube first end;

wherein the annular channel is adapted to convey drilling fluid under pressure toward the inner tube first end, and the inner tube is adapted to convey cuttings toward the inner tube second end.

2. The assembly of claim 1 wherein the outer tube comprises a plurality of rigid outer tube sections, each of said rigid outer tube sections having a pair of threaded ends adapted to be removably connected to a threaded end on another rigid outer tube section.

3. The assembly of claim 1 including a drilling mechanism adjacent to the inner tube first end.

4. The assembly of claim 1 wherein the inner tube includes a means for reinforcing the inner tube, which means does not substantially restrict the flexibility of the outer tube.

5. The assembly of claim 1 wherein the inner tube comprises a conductive element for conveying a signal an/or electricity.

6. The assembly of claim 5 wherein the conductive element is continuous from the inner tube first end to the inner tube second end.

7. The assembly of claim 5 including a steering mechanism adapted to receive the signal from the conductive element and monitor the direction of the drilling mechanism.

8. The assembly of claim 5 wherein the conductive element is substantially enclosed within the inner tube.

9. The assembly of claim 5 wherein the conductive element comprises at least one metallic or fiber optic material.

10. The assembly of claim 5 wherein the conductive element comprises metallic wire, metallic mesh or thin wall pipe.

11. The assembly of claim 1 including at least one centering element that is located in the annular channel.

12. The assembly of claim 11 wherein each centering element comprises a flexible sleeve adapted to maintain the outer tube and the inner tube in a substantially concentric as well as axial relationship to each other, said flexible sleeve having at least one opening therein.

13. The assembly of claim 12 wherein the cumulative area of the opening or openings in each flexible sleeve is less than or equal to the cross-sectional area defined by the inner tube inner diameter.

14. The assembly of claim 12 wherein the cumulative area of the opening or openings in each flexible sleeve is greater than the cross-sectional area defined by the inner tube inner diameter.

15. The assembly of claim 1 wherein each flexible inner tube section is in signal and/or electrical communication with each adjacent flexible inner tube section.

16. A method for subsurface drilling a deviated wellbore using dual circulation, said method comprising the steps of:

(A) providing a flexible dual wall drill string assembly, said assembly comprising:

(1) a metallic outer tube having;

(I) an outer tube first end;

(ii) an outer tube second end opposite the outer tube first end;

(2) a flexible, substantially non-metallic inner tube that is substantially enclosed within and generally coaxially aligned with the outer tube, said inner tube having:

(I) an inner tube first end;

(ii) an inner tube second end opposite the inner tube first end which defines a tube length therebetween;

(iii) an inner tube inner diameter which is generally constant along the tube length from the inner tube first end to the inner tube second end;

wherein the inner tube and the outer tube define an annular channel therebetween wherein the non-metallic inner tube is formed of a material which allows it to bend to an arcuate path of a borehole for drilling a deviated wellbore without limiting bending of the metallic outer tube;

(3) a means for conveying fluid through the annular channel toward the inner tube first end;

wherein the annular channel is adapted to convey drilling fluid under pressure toward the inner tube first end, and the inner tube is adapted to convey cuttings toward the inner tube second end; and (B) drilling a deviated subsurface borehole, at least a portion of which has an arcuate path, by circulating drilling fluid down the annular channel which is formed between the inner tube and the outer tube and by then returning cuttings up the inner tube diameter to the surface.

17. The method of claim 16 which includes drilling a substantially vertical subsurface borehole.

18. The method of claim 16 which includes drilling an arcuate path this is substantially vertical.

19. The method of claim 16 which includes drilling an arcuate path that is generally horizontal.

* * * * *